US009180487B2

(12) United States Patent
Weinelt et al.

(10) Patent No.: US 9,180,487 B2
(45) Date of Patent: Nov. 10, 2015

(54) FLEXIBLE COATING COMPOSITES HAVING PRIMARILY MINERAL COMPOSITION

(75) Inventors: Frank Weinelt, Billerbeck (DE); Ulrich Diester, Olfen (DE); Doris Pasing, Haltern am See (DE)

(73) Assignee: Evonik Degussa GmbH, Essen (DE)

( * ) Notice: Subject to any disclaimer, the term of this patent is extended or adjusted under 35 U.S.C. 154(b) by 552 days.

(21) Appl. No.: 13/393,979

(22) PCT Filed: Jul. 6, 2010

(86) PCT No.: PCT/EP2010/059609

§ 371 (c)(1),
(2), (4) Date: Apr. 16, 2012

(87) PCT Pub. No.: WO2011/026668

PCT Pub. Date: Mar. 10, 2011

(65) Prior Publication Data

US 2012/0196134 A1 Aug. 2, 2012

(30) Foreign Application Priority Data

Sep. 3, 2009 (DE) ..... 10 2009 029 152

(51) Int. Cl.

| | |
|---|---|
| ***B05D 5/08*** | (2006.01) |
| ***D06M 11/45*** | (2006.01) |
| ***D06M 11/64*** | (2006.01) |
| ***D06M 13/513*** | (2006.01) |
| ***D06M 15/263*** | (2006.01) |
| ***D06M 15/564*** | (2006.01) |
| ***D06M 23/08*** | (2006.01) |
| ***D06N 3/04*** | (2006.01) |
| ***D06N 3/18*** | (2006.01) |
| ***D06N 7/00*** | (2006.01) |
| *B05D 7/00* | (2006.01) |
| *C23C 28/00* | (2006.01) |

(52) U.S. Cl.

CPC ..... *B05D 5/083* (2013.01); *B05D 7/584* (2013.01); *D06M 11/45* (2013.01); *D06M 11/64* (2013.01); *D06M 13/513* (2013.01); *D06M 15/263* (2013.01); *D06M 15/564* (2013.01); *D06M 23/08* (2013.01); *D06N 3/047* (2013.01); *D06N 3/183* (2013.01); *D06N 7/0094* (2013.01); *B05D 7/52* (2013.01); *B05D 2701/30* (2013.01); *C23C 28/00* (2013.01); *D06M 2200/01* (2013.01); *D06N 2209/10* (2013.01); *D06N 2209/147* (2013.01); *D06N 2211/06* (2013.01); *Y10T 428/31663* (2015.04)

(58) Field of Classification Search
None
See application file for complete search history.

(56) References Cited

U.S. PATENT DOCUMENTS

| | | | | |
|---|---|---|---|---|
| 612,439 | A | 10/1898 | Schoenefeldt | |
| 4,284,668 | A * | 8/1981 | Nixon | 427/355 |
| 4,347,277 | A | 8/1982 | Slama et al. | |
| 5,458,960 | A * | 10/1995 | Nieminen et al. | 442/404 |
| 2008/0280148 | A1 | 11/2008 | Nun et al. | |
| 2008/0305702 | A1 * | 12/2008 | Nun et al. | 442/71 |
| 2009/0198000 | A1 | 8/2009 | Weinelt et al. | |
| 2010/0159239 | A1 * | 6/2010 | Nun et al. | 428/354 |

FOREIGN PATENT DOCUMENTS

| | | | |
|---|---|---|---|
| AU | 736612 | B2 | 6/1996 |
| AU | 5653398 | A | 6/1998 |
| DE | 10 2004 006 612 | | 8/2005 |
| DE | 10 2005 052 940 | | 5/2007 |
| GB | 1 519 370 | A | 7/1978 |
| JP | 3-269184 | A | 11/1991 |
| JP | 2009-527602 | A | 7/2009 |
| RU | 2 188 763 | C2 | 9/2002 |
| SU | 1505441 | A3 | 8/1989 |
| WO | WO 98/21266 | A1 | 5/1998 |
| WO | 99 15262 | | 4/1999 |
| WO | 2006 032511 | | 3/2006 |
| WO | 2006 032512 | | 3/2006 |
| WO | WO 2007096020 | A1 * | 8/2007 |
| WO | 2011 026671 | | 3/2011 |

OTHER PUBLICATIONS

DIN EN 259-1, "Wallcoverings in roll form Heavy duty wallcoverings Part 1: Specifications," Total 11 Pages, (Dec. 2001).
DIN EN 12524, "Building materials and products—Hygrothermal properties Tabulated design values," Total 12 Pages, (Jul. 2000).
DIN EN 12956, "Wandbekleidungen in Rollen Bestimmung der Masse, Geradheit, Wasserbestaendigkeit und Abwaschbarkeit," Total 9 Pages, (Aug. 1999).
DIN 53122-1, "Determination of the water vapour transmission rate of plastic film, rubber sheeting, paper, board and other sheet materials by gravimetry," Total 7 Pages, (Aug. 2001).
International Search Report Issued Oct. 15, 2010 in PCT/EP10/59609 Filed Jul. 6, 2010.
Japanese Office Action issued Jan. 5, 2015 in Patent Application No. 2012-527254 (English Translation only).

* cited by examiner

*Primary Examiner* — Timothy Meeks
*Assistant Examiner* — Michael P Rodriguez
(74) *Attorney, Agent, or Firm* — Oblon, McClelland, Maier & Neustadt, L.L.P.

(57) ABSTRACT

The invention relates to a method for producing a flexible mineral building material and the building material obtained according to said method.

15 Claims, No Drawings

FLEXIBLE COATING COMPOSITES HAVING PRIMARILY MINERAL COMPOSITION

The present invention relates to a process for producing a flexible predominantly mineral coating composite for the production or the coating of construction materials, and also to the production processes needed for this purpose.

Within the prior art there is a requirement for coating to alter or improve the surface properties of substrates. In particular, coatings can improve resistance to mechanical effects or resistance to aggressive substances. The substrates coated can have very different properties. Substrates used in the construction materials sector can be hard, i.e. inflexible, an example being concrete, stone, ceramic or wood. However, there is also a very wide field of application for flexible construction materials, e.g. surface coverings for walls, floors and ceilings. Particular products which may be mentioned here are composite materials, such as flexible tiles, textiles, wallpapers or floorcoverings such as linoleum.

A factor common to all substrates is that they have to have a surface which withstands a relatively high level of stress during use. One requirement is that they are resistant to the effects of substances such as aggressive chemicals or to environmental effects such as UV radiation and water. On the other hand, in other fields it is advantageous for the construction materials to have good resistance to soiling, and to be easy to clean and to resist mechanical stress.

In other fields, e.g. the field of wovens and knits, there is a need for coatings to improve surface properties. Here, the fundamental stability of a composite is provided by the substrate, while the resistance to aggressive substances, or mechanical stress, or else the increased resistance to soiling, is provided by coatings applied.

In the case of flexible substrates there is a particular need that coatings applied are sufficiently flexible to participate in deformation of the flexible substrate without damage to their structure. When a flexible substrate is bent, stresses occur at the surface of the substrate. However, said stresses must be prevented from causing impairment to the coating of a substrate, e.g. via cracking. Furthermore, aging phenomena in the composite materials must be prevented for an appropriate period from causing embrittlement which in turn eliminates the advantages mentioned.

The prior art reveals processes for applying coatings on flexible substrates while avoiding any adverse effect on the coating when the substrate is deformed.

WO 99/15262 discloses a permeable composite material. Here, a coating is applied to a permeable carrier and is subsequently hardened. The coating comprises at least one inorganic component, where an inorganic component comprises at least one compound made of a metal, semimetal or mixed metal with at least one element of the third to seventh main group of the Periodic Table of the Elements. The coating composition can be obtained via hydrolysis of a precursor. A sol can form here, which is subsequently applied to the permeable substrate.

A feature of the permeable composite materials disclosed in WO 99/15262 is that they represent a robust composite material and protect the substrate or the base to which they are applied, and that no impairment of the applied coating occurs even when the curvature radii of the composite material are small. Disadvantages of said composite materials are their high and intended permeability, the high absorbency for liquids and, associated therewith, the low resistance to soiling and to abrasion, properties which do not provide substrates and/or bases adequately protected for the intended applications. However, the desire to reduce the permeability of composite materials of this type and to overcome said disadvantages have hitherto led to brittle material or to a markedly less flexible material.

The specification DE 10 2004 006612 A1 teaches use of a ceramic coating to protect a carrier material from scratching and to render the material washable. An intermediate layer can moreover be applied, comprising particles made of $Al_2O_3$, $ZrO_2$, $TiO_2$ and/or $SiO_2$, where these have a surrounding silicate network. A main disadvantage of composite materials of this type is that they can easily be soiled and have high brittleness, the reason for the latter being that the scratch resistance, which is per se desirable, is obtained by using the adhesion promoters described in that document.

The specification WO 2007/051680 describes a technical solution for applying sol-gel coatings with greater thickness than has been possible in the previous prior art. These thicker layers are intended to protect the substrate effectively from environmental effects. Said approach is assisted by the use of silanes which have fluorocarbon groups.

The relatively high materials costs are a disadvantage of said procedure and inhibit marketing of said material. They are the result of the thicker layers and of any possible use of the fluorosilanes. Without the use of fluorosilanes, said materials have no resistance to soiling. Another disadvantage is that the resultant materials are subject to an aging process which becomes apparent in the increase of brittleness over time. This is disadvantageous for processing of older material.

There is therefore a further requirement to influence the surface properties of flexible substrates. It is desirable firstly to devise a method of obtaining the advantages of a mineral coating, such as those achieved via the sol-gel processes, but also to eliminate the disadvantages caused by coating systems of that type.

The technical object which underlies the present invention is the provision of inexpensive coated substrates which have a coating which protects the substrate or the base from environmental effects and from wear during use, where the substrate can also be flexible and the coating is not adversely affected by deformation of a composite material of this type even after aging. Another object of the present invention is to provide a process for producing these improved composite materials.

Said object is achieved via a process for producing a flexible mineral construction material, comprising the following steps:

1) provision of a substrate,
2) applying a composition on at least one side of the substrate, where
   the composition comprises at least one inorganic compound
   and each inorganic compound comprises
   at least one metal and/or semimetal
   selected from the group of Sc, Y, Ti, Zr, Nb, V, Cr, Mo, W, Mn, Fe, Co, B, Al, In, Tl, Si, Ge, Sn, Zn, Pb, Sb, Bi or a mixture of the same
   and at least one element
   selected from the group of Te, Se, S, O, Sb, As, P, N, C, Ga or a mixture of the same,
   and drying said composition, and then
3) applying at least one organic polymer dispersion on at least one side of the substrate obtained in step 2),
   and drying said coating or coatings,
   or
4) applying at least one coating on at least one side of the substrate, where the coating comprises a mixture made of silanes of the general formula $(Z^1)Si(OR)_3$, where $Z^1$=R, gly (gly=3-glycidyloxypropyl), AP (3-aminopropyl), and/or AEAP (N-(2-aminoethyl)-3-aminopropyl), and R is an alkyl or alicyclic moiety having from 1 to 18 carbon atoms and all R can be identical or different, oxide particles selected from the oxides of Ti, Si, Zr, Al, Y, Sn, Zn, Ce or a mixture of the same, at least one polymer or initiator, and drying said coating or coatings, and then 5) applying at least one organic polymer dispersion to at least one side of the substrate, and drying said coating or coatings.

The advantage of the coating obtained after step 2) of the process of the invention is the increase in mechanical stability, providing a stable structure which achieves fundamental protection of the substrate and of any base, equivalent to a spatial barrier. Said process step of the invention moreover provides mechanical stabilization of substrates which have a tendency toward fractures or cracking.

The benefit of the coating obtained after step 3) or after step 4) of the process of the invention consists in reinforcement of the coating of step 2) and preparing the surface to develop the desired surface properties on implementation of step 5).

The advantage of the coating obtained after step 5) of the process of the invention is development of the surface properties of the composite material of the invention.

The process of the present invention is not subject to any limitation to specific substrates. The substrates can be either open-pored substrates or closed-pored substrates. In particular, the substrate in step 1) can be a flexible and/or rigid substrate. In one preferred embodiment, the substrate of step 1) is a knit, a woven, a braid, a foil and/or a sheet.

It is preferable that the substrate in step 1) is in essence resistant to temperature change under the drying conditions of steps 2) and 3) or 4) and 5).

In one preferred embodiment, the inorganic compound of step 2) is selected from $TiO_2$, $Al_2O_3$, $SiO_2$, $ZrO_2$, $Y_2O_3$, BC, SiC, $Fe_2O_3$, SiN, SiP, alumosilicates, aluminum phosphates, zeolites, partially exchanged zeolites, and mixtures of the same. Examples of preferred zeolites are Wessalith® products or ZSM products or amorphous microporous mixed oxides.

The grain size of the inorganic compound of step 2) is preferably from 1 nm to 10 000 nm. It can be advantageous for the composite material of the invention to have at least two grain size fractions of the at least one inorganic compound. The grain size ratio can be from 1:1 to 1:10 000, preferably from 1:1 to 1:100. The quantitative proportion of the grain size fractions in the composition of step 2) can preferably be from 0.01:1 to 1:0.01. The composition of step 2) is preferably a suspension, which is preferably an aqueous suspension. The suspension can preferably comprise a liquid selected from water, alcohol, acid, and a mixture of the same.

In an embodiment to which further preference is given, the inorganic compound of step 2) can be obtained via hydrolysis of a precursor of the inorganic compound, comprising the metal and/or semimetal. The hydrolysis process can use, for example, water and/or alcohol. An initiator can be present during the hydrolysis process and is preferably an acid or base, which is preferably an aqueous acid or base.

The precursor of the inorganic compound is preferably one selected from metal nitrate, metal halide, metal carbonate, metal alcoholate, semimetal halide, semimetal alcoholate and a mixture of the same. Examples of preferred precursors are titanium alcoholates, e.g. titanium isopropoxide, silicon alcoholates, e.g. tetraethoxysilane, and zirconium alcoholates. Examples of preferred metal nitrates are zirconium nitrate. In one advantageous embodiment, the composition comprises, in relation to the hydrolyzable precursor, based on the hydrolyzable group of the precursor, at least half the molar amount of water, water vapor or ice.

In one preferred embodiment, the composition of step 2) is a sol. In one preferred embodiment, commercially available sols can be added, an example being titanium nitrate sol, zirconium nitrate sol or silica sol. In one preferred embodiment, silanes of the formula $(Z^2)Si(OR)_3$, where $Z^2$ is R, OR, gly (gly=3-glycidyloxypropyl), AP (aminopropyl) and/or AEAP (N-2-aminoethyl-3-aminopropyl) and R is an alkyl moiety having from 1 to 18 carbon atoms, and all R can be identical or different, or else oxide particles selected from the oxides of Ti, Si, Zr, Al, Y, Sn, Zn, Ce, or a mixture of the same can be added. The size of the oxide particles can be from 10 nm to 100 μm.

The drying of the composition in step 2) is preferably implemented via heating to a temperature of from 50° C. to 1000° C. In one preferred embodiment, drying is carried out for from 10 seconds to 5 hours at a temperature of from 50° C. to 500° C. and is very preferably carried out for from 20 seconds to 30 minutes at a temperature of from 120° C. to 250° C.

The drying in step 2) can be achieved by means of heated air, hot air or heat generated electrically. Radiation curing can also take place, for example by means of infrared or microwave radiation.

A further coating process corresponding to steps 3) or 4) can take place as a function of the requirements profile with which the final application has to comply. The function of this coating consists in essence in the development of a stable composite material.

The repetition of steps 3) and, respectively, 4) can be implemented in any desired sequence. This procedure advantageously increases the stability of the construction material, since the repetition of 3) and/or 4) gives a plurality of thin layers bonded intimately but nevertheless not rigidly to one another.

In one preferred embodiment, the coating of step 3) comprises a polymer dispersion, a mixture of various polymer dispersions, or a formulation made of at least one polymer dispersion. The polymer dispersions can be composed of polymeric substances derived from polyacrylates, polymethacrylates, polyurethanes, polyolefins, polycarbonates, polyesters, polyamides, polyimides, polyetherimides, silicone resins, and combinations or copolymers/cocondensates, optionally with use of further vinyl monomers of these, where these optionally comprise additional functions for the crosslinking process, e.g. epoxide, isocyanate, capped isocyanates, and/or radiation-curable double bonds.

The average molar mass of the polymers is preferably greater than 10 000 g/mol, particularly preferably greater than 20 000 g/mol.

The polymer dispersions can be aqueous or can comprise organic solvents. The wet-application rate for polymer dispersion is from 10 to 200 g/m$^2$, and the solids concentrations used in the liquor here are from 0.1 to 150 g/L, preferably from 3 to 100 g/L.

It is particularly preferable to use aqueous polymer dispersions in step 3). Said dispersions can be self-emulsifying or can be stabilized with emulsifiers.

It is particularly advantageous to use polymer dispersions which have high wash permanency. For efficient use, it is moreover possible to add the following in a known manner to the polymer dispersions: auxiliaries, e.g. emulsifiers, defoamers, fixing resins, fungicides, and antistatic agents, or catalysts.

The polymer dispersions can be applied by way of doctoring, spray application, roller coating, dip coating, padding, flow coating, or foam application, or via brushing, in a manner known per se.

The drying of the composition in step 3) is preferably implemented via heating to a temperature of from 80° C. to 250° C. In one preferred embodiment, drying is carried out for from 10 seconds to 6 hours at a temperature of from 110° C. to 210° C. and very particularly preferably from 20 seconds to 60 minutes at a temperature of from 130° C. to 190° C.

The drying in step 3) can be achieved by means of heated air, hot air, IR radiation, microwave radiation or heat generated electrically.

In one preferred embodiment of the coating of step 4), R and/or $Z^1$ in the general formula $(Z^1)Si(OR)_3$ is methyl, ethyl, or a straight-chain, branched, or alicyclic alkyl moiety having 3, 4, 5, 6, 7, 8, 9, 10, 11, 12, 13, 14, 15, 16, 17, and/or 18 carbon atoms, alongside the other definitions of $Z^1$.

In an embodiment to which further preference is given, the coating of step 4) comprises 3-glycidyloxypropyltriethoxysilane and/or 3-glycidyloxypropyltrimethoxysilane as silane, and 3-aminopropyltrimethoxysilane, 3-aminopropyltriethoxysilane, N-2-aminoethyl-3-aminopropyltrimethoxysilane, and/or N-2-aminoethyl-3-aminopropyltriethoxysilane as second silane. The coating of step 4) preferably comprises, as further silane, a silane of the formula $R_zSi(OR)_{4-z}$, where z is 1 or 2 and all R can be identical or different and can comprise from 1 to 18 carbon atoms. If there are from 3 to 18 carbon atoms, the carbon chain can be a branched or linear chain.

It is further preferable that the coating of step 4) comprises a mixture made of at least two polymers.

It is further preferable that the following are present in the coating of step 4): butyltriethoxysilane, isobutyltriethoxysilane, octyltriethoxysilane, dodecyltriethoxysilane and/or hexadecyltriethoxysilane. In particular, it has been found that when alkylsilanes are used in the step 4 a synergistic effect is achieved on the development of the antisoiling properties on the final coating in the composite material described.

In one preferred embodiment, the coating of step 4) comprises, as initiator, an acid or base which is preferably an aqueous acid or base.

It is preferable that the surface of the oxide particles present in the coating of step 4) is hydrophobic. At the surface of the oxide particles of the coating of step 4) there are preferably organic moieties $X_{1+2n}C_n$ bonded to silicon atoms, where n is from 1 to 20 and X is hydrogen and/or fluorine. The organic moieties can be identical or different. n is preferably 1, 2, 3, 4, 5, 6, 7, 8, 9, 10, 11, 12, 13, 14, 15, 16, 17, 18, 19 and/or 20. It is preferable that the groups bonded to silicon atoms are methyl, ethyl, propyl, butyl, and/or pentyl groups. In one particularly preferred embodiment, there are trimethylsilyl groups bonded to the surface of the oxide particles. The organic moieties can preferably be cleaved and with further preference can be hydrolyzed.

The oxide particles of the coating of step 4) can have been selected from the oxides of Ti, Si, Zr, Al, Y, Sn, Zn, Ce, and mixtures of the same. It is preferable that the oxide particles of the coating of said step are to some extent hydrolyzed under the reaction conditions thereof at the surface of the oxide particles. It is preferable that reactive centers form here, where these react with the organic silicon compounds of the coating of step 4). Said organic silicon compounds can become bonded covalently to the oxide particles via, for example, —O— bonds during the drying process. This results in covalent crosslinking of the oxide particles to the coating as it hardens.

The average size of the oxide particles can be from 10 nm to 10 μm, preferably from 20 to 1000 nm, more preferably from 30 to 500 nm. If the coating is intended to be transparent and/or colorless, it is preferable to use only oxide particles of average size from 10 to 250 nm. The average particle size is based on the size of the primary particles or, if the oxides take the form of agglomerates, on the size of the agglomerates. The particle size is determined via light-scattering methods, for example by using HORIBA LB 550® equipment (from Retsch Technology).

The mass-average molar mass of the polymer in the coating of step 4) is preferably at least 3000 g/mol. The mass-average molar mass is preferably at least 5000 g/mol, more preferably at least 6000 g/mol, and most preferably at least 10 000 g/mol.

The average degree of polymerization of the polymer of the coating of step 4) is preferably at least 50. In an embodiment to which preference is further given, the average degree of polymerization is at least 80, more preferably at least 95, and most preferably at least 150. The polymer of the coating of step 4) is preferably selected from polyamide, polyester, epoxy resins, melamine-formaldehyde condensate, urethane-polyol resin, and mixtures of the same.

The amount of the coating applied in step 4) is preferably such that drying gives a layer of the dried coating with thickness from 0.05 to 30 μm. It is preferable that there is a coating of step 4) with thickness from 0.1 μm to 20 μm, and most preferably from 0.2 μm to 10 μm, on the dried material.

The coating 4) can be applied by way of doctors, spray application, roller coating, dip coating, flow coating, or via brushing, in a manner known per se.

Any process known to the person skilled in the art can be used to implement the drying of the coating in step 4). In particular, an oven can be used to implement the drying process. Preference is further given to using a convection oven, microwave oven, or other oven, or infrared radiation, for the drying process. In one preferred embodiment, the coating 4) is dried via heating to a temperature of from 50° C. to 300° C. for from 1 second to 30 minutes, and is very particularly preferably dried at from 110 to 200° C. during a period of from 5 seconds to 10 minutes. Radiation curing by means of UV radiation or electron beams can follow if technically advisable and necessary.

In another preferred embodiment, the material is dried in step 4) at a temperature of from 100° C. to 800° C. for from 1 second to 10 minutes.

In one preferred embodiment, the coating of step 5) comprises a polymer dispersion, a mixture of various polymer dispersions, or a formulation made of at least one polymer dispersion. The polymer dispersions may be composed of polymeric substances derived from polyacrylates, polymethacrylates, polyurethanes, polyolefins, polycarbonates, polyesters, polyamides, polyimides, polyetherimides, silicone resins, and combinations or copolymers/cocondensates, optionally with use of further vinyl monomers of these, where these optionally comprise additional functions for the crosslinking process, e.g. epoxide, isocyanate, capped isocyanates, and/or radiation-curable double bonds.

The average molar mass of the polymers is preferably greater than 10 000 g/mol, particularly preferably greater than 20 000 g/mol.

The dispersions can be aqueous or can comprise organic solvents. The wet-application rate for polymer dispersion is from 10 to 200 g/m$^2$, and the solids concentrations used in the liquor here are from 0.1 to 120 g/L, preferably from 3 to 70 g/L.

It is particularly preferable to use aqueous polymer dispersions in step 5). These dispersions can be self-emulsifying or can be stabilized with emulsifiers.

It is particularly advantageous to use polymer dispersions which have high wash permanency. For efficient use, it is moreover possible to add the following in a known manner to the polymer dispersions: auxiliaries, e.g. emulsifiers, defoamers, fixing resins, fungicides, and antistatic agents, or catalysts.

The polymer dispersions can be applied by way of doctoring, spray application, roller coating, dip coating, padding, flow coating, or foam application, or via brushing, in a manner known per se.

It can be advantageous, after step 3) or 4), to implement step 5) repeatedly, and particularly preferably to implement it repeatedly in such a way that between two successive implementations of step 5) no other step of the process according to the invention is implemented. It can moreover be advantageous to use fluorocarbons in at least one implementation of step 5), particularly preferably in the final implementation of said step. If step 5) is implemented only once, it is very particularly preferable to use fluorocarbons in said implementation.

The fluorocarbons preferably comprise fluoroalkyl groups $CF_3C_nF_{2n}$, where n=1 to 17, particularly preferably n=3 to 11, or ether chains of the following structures: $CF_3CFR''[—O—CF_2CFR'']_p$, where p=0 to 10 and R''=F, Cl, $CF_3$.

Polymers having fluorinated side chains can be used with particular preference, and very particular preference is given to those which are also combined with non-fluorinated hydrocarbon side chains.

If step 5) is implemented repeatedly and fluorocarbons are used in more than one implementation, it can also be advantageous to use, in each implementation, fluorocarbons having identical fluoroalkyl groups, having identical ether chains, and/or having identical side chains of the fluorinated chains.

The polymer dispersions can comprise crosslinking agents (e.g. capped isocyanates). The polymer dispersions can preferably have been cationically modified and can comprise boosters and extenders. The crosslinking agents can also act as boosters. If fluorocarbon dispersions are used, the amount of organically bonded fluorine applied is from 0.01 to 12 g/m$^2$, preferably from 0.1 to 6 g/m$^2$.

The drying of the composition in step 5) is preferably implemented via heating to a temperature of from 80° C. to 250° C. In one preferred embodiment, drying is carried out for from 10 seconds to 6 hours at a temperature of from 110° C. to 210° C. and very particularly preferably from 20 seconds to 60 minutes at a temperature of from 130° C. to 190° C.

The drying in step 5) can be achieved by means of heated air, hot air, IR radiation, microwave radiation or heat generated electrically.

In an embodiment to which further preference is given, at least one further coating can be applied before application of the coating in step 3) or 4) and 5). Said further coating can by way of example be a print. This type of print can be applied by any printing process familiar to the person skilled in the art, in particular the offset printing process, flexographic printing process, or pad printing, or the inkjet printing process.

If the coated substrate in its finished embodiment is to be applied to a base, it is possible in another embodiment, after the application of the coating in step 2), 3), or 4) and 5), to apply a further coating in the form of reverse-side coating. Said barrier layer then forms the reverse side and if further coatings follow these are then only applied on the opposite side. Said further coating is not subject to any restriction and can be any coating known to the person skilled in the art. Said coating can also be a print.

Surprisingly, coated substrates of the present invention exhibit very high flexibility, if the substrate is flexible. It is therefore possible to bend the substrate without tearing or destroying the coatings applied. In particular, it is thus possible to produce composite materials which by way of example are used in the form of flexible tiles and conform to the surface contours of a base, without any adverse effect on the coating. As described above, a very wide variety of protective layers can be applied in the form of coating, in particular layers for protection from aggressive chemicals, or dirt-repellant coatings.

Surprisingly, it has been found that use of organic polymer dispersions for the purposes of the process according to the invention for the topcoats in the composite materials described not only significantly reduces the resultant dry application rates in comparison with the prior art of DE 10 2004 006612 A1 or WO 2007/051680 while retaining the properties of the materials, with a resultant marked increase in cost-effectiveness, but also provides an overall increase in wash resistance and abrasion resistance, and also markedly improves the stain resistance factor in comparison with said prior art, and markedly reduces embrittlement on aging.

The achievement of an increase in the mechanical resistance of the finished composite material to abrasion specifically with a reduction in the amounts of materials used was contrary to all expectations because by way of example WO 2007/051680 teaches that an improvement in abrasion resistance requires thicker layers.

It is moreover surprising that, despite the increased resistance to washing and to abrasion, and also the better stain resistance factor, the composite materials described have exceptionally low resistance to diffusion of water vapor (the term used being water vapor diffusion resistance).

The water vapor diffusion resistance, also termed water vapor equivalent air-layer thickness $s_D$, expresses the extent to which a construction material inhibits thermally driven diffusion of water vapor. The water vapor diffusion resistance coefficient is used to relate water vapor diffusion resistances of various materials to the water vapor diffusion resistance of air.

The water vapor diffusion resistance coefficient (symbol μ) of a construction material is a dimensionless index for the material. It gives the factor by which the material concerned is less permeable to water vapor than a stationary air layer of identical thickness. As above said index for the material increases, a construction material becomes less permeable to water vapor. By definition, for air $$\mu=1.$$

DIN EN 12524 states the values for p for the most familiar construction materials.

The water vapor diffusion resistance coefficient is important for calculating the vapor diffusion flow rate through components. Vapor diffusion depends on the diffusion resistances of the individual layers.

The standard DIN 53122-1 states the method for determining water vapor equivalent air layer thickness $s_D$, unit meters. The water vapor diffusion resistance is accordingly calculated as follows:

$$\mu\times\text{thickness(in meters)}.$$

The thickness is the thickness in m of the stationary air layer which has the same water vapor diffusion resistance. By way of example, the diffusion resistance of a brick wall of thickness 20 cm is $$5\times0.2\ m=1\ m$$

and this is equivalent to saying that the amount of water vapor flowing through a brick wall of thickness 20 cm is the same as that flowing through a stationary air layer of thickness 1 m.

By way of example, contrary to widely held opinion, polystyrene is very vapor-permeable—approximately comparable to wood: the $S_D$ value for a Styropor sheet of thickness 4 cm is about 50×0.04 m=2 m.

The value of $s_D$) for vapor barrier foils by way of example is from about 0.25 m to 10 m. There are embodiments of vapor barrier foils which are more open-pored in humid air than in dry air.

The process according to the invention provides mineral construction materials of which the water vapor equivalent air layer thickness $s_D$ is far superior to that of the coatings of the cited prior art DE 10 2004 006612 A1 or WO 2007/051680. A low value of $s_D$ is important for developing good conditions of temperature and humidity in closed spaces which had exposure to periods of high humidity.

The present invention also provides the flexible mineral construction material obtained by the process of the invention.

Although the literature relating to production of good water repellency and good oil repellency on various organic surfaces and concrete describes the use of fluorocarbon-containing polymers and offers the prospect of wash permanence of particular systems on textiles made of natural fibers and synthetic fibers, it was surprising that all of these advantages and effects were achieved.

The present invention therefore likewise provides a flexible mineral construction material which has a stain resistance factor of at most 10, a tensile strain at break of at least 13%, a tensile strain at break of at least 10% after 7 d of aging at 60° C., a minimum bending radius of at most 3 mm, and a water vapor equivalent air-layer thickness $S_D$ of at most 0.2 m.

EXAMPLES

Comparative Example 1

Production of First Coating 31.3 g of water, 4.3 g of 65% nitric acid, and 12.6 g of ethanol were used as initial charge, and 48.1 g of aluminum oxide powder ($d_{50}$=2.7 μm; BET=1.3 $m^2/g$), and also 0.56 g of dispersing agent, were added and stirred. A mixture made of 0.0146 mol of silanes (Dynasylan® MTES, TEOS, and GLYMO in a ratio of 1.00:0.86:1.52) was added to said dispersion. The mixture was stirred for 24 h at RT.

A laid PET non-woven (weight per unit area: 45 $g/m^2$; thickness 0.39 mm) was saturated with said dispersion and dried and hardened in an oven at 220° C. for 10 sec. The amount of the dispersion applied was sufficient to give a coated non-woven with dry weight 220 $g/m^2$.

Production of Second Coating 2.9 g of Aerosil® R812S were dispersed in 67.7 g of GLYMO, and then 26.0 g of bisphenol A, and also 3.4 g of 1% HCl, were added with stirring. After 24 h of stirring at 6° C., 2.3 g of methylimidazoline and 10.2 g of Bakelite EPR 760 were added and stirred for a further 20 h.

Said composition was applied at 20 $g/m^2$ wet to the previously produced coating and hardened at 120° C. for 30 min.

Testing of said material gave the following property profile:

| | |
|---|---|
| Stain resistance factor | 15 |
| Abrasion resistance | 13 |
| Tensile strain at break [%] | 2.5 |

The stain resistance factor is assessed by applying from 1 to 3 ml of coffee, tea, tomato ketchup, mustard, 1% NaOH, 10% citric acid solution, "Hair & Body" shower gel from Stoko Skincare, grape juice, and vegetable oil for one hour and rinsing with water with no further mechanical cleaning. Assessment points are awarded for each respective test liquid:

No visible changes: 0;

Changes in gloss and color just discernible: 1;

Slight changes in gloss and color: 2;

Distinct marking of surface, no substantial damage to structure of test area: 3;

Distinct marking visible, changes in structure of test area: 4;

Distinct changes in test area: 5.

The stain resistance factor is the sum of the points awarded for each test liquid.

Abrasion resistance is determined to DIN EN 12956 and DIN EN 259-1 for highly abrasion-resistant surfaces. The specific method uses observation at three optical viewing angles: view from above using a lens (8×), viewing the surface at an acute angle, and viewing transversely across the illuminated surface against a black background.

Evaluation: 0 points for no change, 10 points for visible change according to the standard, 1 point for visibility of protruding fibers, 2 points for a large number of protruding fibers, and 3 points for gloss change at the acute angle. The total derived from the evaluation criteria is calculated.

Tensile strain at break is measured with a Zwick Z2.5/PN1S device.

Comparative Example 2

Production of First Coating 15.0 g of water, 0.6 g of 65% nitric acid, and 7.9 g of ethanol were used as initial charge, and 71.0 g of aluminum oxide powder (CT3000 SG (AlCoA)), and also 0.1 g of dispersing agent, were added and stirred. A mixture made of 0.0249 mol of silanes (Dynasylan® MTES, TEOS, and GLYMO in a ratio of 1.00:0.86:1.50) was added to said dispersion. The mixture was stirred for 24 h at RT.

Said dispersion was applied at thickness 50 μm to a PET non-woven (PET FFKH 7210), and dried at 130° C. for 30 min in an oven.

Production of Second Coating 29.5 g of GLYEO were used as initial charge, and 2.6 g of 1% hydrochloric acid were added with stirring. Once the mixture had cleared, 42.9 g of a 15% dispersion of Aerosil® R812S in ethanol were added. 25 g of Dynasylan® AMEO were added dropwise to said mixture over a period of 20 min.

Said composition was applied at 50 $g/m^2$ wet to the previously produced coating and hardened at 140° C. for 30 min.

Testing of said material gave the following property profile:

| | |
|---|---|
| Stain resistance factor | 27 |
| Abrasion resistance | 15 |
| Tensile strain at break [%] | 4.5 |

Comparative Example 3

Production of First Coating 36.5 g of water, 0.5 g 65% of nitric acid, and 3.4 g of ethanol were used as initial charge, and 56.1 g of aluminum oxide powder ($d_{50}$=2.7 μm; BET=1.3 $m^2/g$), and also 0.07 g of dispersing agent, were added and stirred. A mixture made of 0.0162 mol of silanes (Dynasylan® MTES, TEOS, and GLYMO in a ratio of 1.00:0.86:1.36) was added to said dispersion. The mixture was stirred for 24 h at room temperature. A PET non-woven (PET FFKH 7210) was saturated with said dispersion and dried at 220° C. for 3 min in an oven.

Production of Second Coating 24 g of GLYEO were used as initial charge, and 2.5 g of 1% hydrochloric acid were added with stirring. Once the mixture had cleared, 34.5 g of a 15% dispersion of Aerosil® R812S in ethanol were added. 20 g of Dynasylan® AMEO and then 6.5 g of Dynasylan F8261 were added dropwise to said mixture over a period of 20 min. 12.5 g of Bakelite EPR 760 were added, and then this material was used for a coating. Said composition was applied at 100 $g/m^2$ wet to the previously produced coating and hardened at 150° C. for 3 min. Said procedure was repeated once, so that the total number of coatings on the substrate is three.

Testing of said material gave the following property profile:

| | |
|---|---|
| Stain resistance factor | 2 |
| Abrasion resistance | 15 |
| Tensile strain at break [%] | 14.4 |
| Tensile strain at break [%] after aging at 60° C. for 7 d | 5.0 |
| Water vapor equivalent air layer thickness $s_D$ | 0.38 m |

Examples of the Invention

Example I 36 g of water, 0.5 g of 65% nitric acid, and 3.5 g of ethanol were used as initial charge, and 56 g of aluminum oxide powder ($d_{50}$=2.7 μm; BET=1.3 $m^2/g$), and also 0.07 g of dispersing agent, were added and stirred. A mixture made of 0.017 mol of silanes, composed of Dynasylan® MTES, TEOS, and GLYMO in a ratio of 1.00:0.86:1.51, was added to said dispersion. The mixture was stirred for 24 h at room temperature.

A PET non-woven (weight per unit area: 45 $g/m^2$; thickness 0.39 mm) was saturated with said dispersion and dried at 230° C. in an oven.

Production of Second Coating 1.8 g of water and 0.03 g of 65% $HNO_3$ were introduced into 21 g of Dynasylan GLYEO and stirred until clear. 8.6 g of Aerosil R812S and 48.9 g of ethanol were introduced into said solution. 18 g of Dynasylan AMEO and 2.5 g of Dynasylan IBTEO were added to said suspension and stirred at room temperature for a further 24 h.

The previously coated substrate was coated with said mixture and dried at 150° C. in an oven.

Production of Third Coating 3 g of Fluowet UD, 3 g of Genagen LAB, and 50 g of Nuva® N2114 from Clariant were introduced into 900 g of water and mixed until homogeneous. Said dispersion was applied to the coated substrate by padding. The wet application rate was about 100 $g/m^2$. The coated specimen was then dried at 100° C. and hardened at 170° C. for 90 sec.

Testing of said material gave the following property profile:

| | |
|---|---|
| Stain resistance factor | 5 |
| Abrasion resistance | 5 |
| Tensile strain at break [%] | 15.2 |
| Tensile strain at break [%] after aging at 60° C. for 7 d | 14.6 |
| Water vapor equivalent air layer thickness $s_D$ | 0.06 m |
| Bending radius | 2 mm |

Example II

Production of First Coating 36 g of water, 0.6 g of 53% nitric acid, and 3.4 g of ethanol were used as initial charge, and 56 g of aluminum oxide powder ($d_{50}$=2.7 μm; BET=1.3 $m^2/g$), and also 0.07 g of dispersing agent, were added and stirred. A mixture made of 0.025 mol of silanes (Dynasylan® MTES, TEOS, and GLYMO in a ratio of 1.04:1.0:0.86) was added to said dispersion. The mixture was stirred for 24 h at 40° C.

A PET non-woven (weight per unit area: 45 $g/m^2$; thickness 0.39 mm) was saturated with said dispersion and dried and hardened at 230° C. in an oven.

Production of Second Coating 1.8 g of water and 0.03 g of 65% $HNO_3$ were introduced into 21 g of Dynasylan GLYEO and stirred at room temperature until clear. 8.6 g of Aerosil R812S and 48.9 g of ethanol were introduced into said solution. 18 g of Dynasylan AMEO and 2.5 g of Dynasylan IBTEO were added to said suspension and stirred for a further 24 h.

The previously coated PET non-woven was coated with said mixture and dried at 150° C. in an oven.

Production of Third Coating 3 g of Genagen LAB and 3 g of Fluowet UD were dissolved in 900 g of water and 100 g of Nuva® TTC from Clariant were also introduced and mixed until homogeneous. Said dispersion was applied to the previously coated substrate by padding. The wet application rate was about 100 $g/m^2$. The coated specimen was then dried at 100° C. and hardened at 180° C. for 30 sec.

Testing of said material gave the following property profile:

| | |
|---|---|
| Stain resistance factor | 2 |
| Abrasion resistance | 3 |
| Tensile strain at break [%] | 18.8 |
| Tensile strain at break [%] after aging at 60° C. for 7 d | 17.2 |
| Bending radius | 2 mm |
| Water vapor equivalent air layer thickness $s_D$ | 0.05 m |

Example III

Production of First Coating 35 g of water, 0.6 g of 53% nitric acid, and 3.3 g of ethanol were used as initial charge, and 54 g of aluminum oxide powder ($d_{50}$=2.7 μm; BET=1.3 $m^2/g$), and also 0.06 g of dispersing agent, were added and stirred. A mixture made of 0.0334 mol of silanes (Dynasylan® MTES, TEOS, and GLYMO in a ratio of 1.00:1.00:0.57) was added to said dispersion. The mixture was stirred for 24 h at 40° C.

A PET non-woven (weight per unit area: 45 $g/m^2$; thickness 0.39 mm) was saturated with said dispersion and dried and hardened at 230° C. in an oven.

Production of Second Coating 3 g of Fluowet UD and 3 g of Genagen LAB were dissolved in 700 g of water, and 300 g of RUCO-COAT PU 8510 from Rudolf GmbH were also introduced and mixed until homogeneous. Said dispersion was applied to the previously coated substrate by padding. The wet application rate was about 180 g/m$^2$. The coated specimen was then dried at 100° C. and hardened at 160° C. for 2 min.

Production of Third Coating 3 g of Genagen LAB and 3 g of Fluowet UD were dissolved in 900 g of water, and 100 g of Nuva® TTC from Clariant were also introduced and mixed until homogeneous. The substrate was flow-coated with said dispersion and a doctor was used for draw-off. The wet application rate was about 120 g/m$^2$. The coated specimen was then dried at 100° C. and hardened at 180° C. for 30 sec.

Testing of said material gave the following property profile:

| | |
|---|---|
| Stain resistance factor | 5 |
| Abrasion resistance | 5 |
| Tensile strain at break [%] | 20.4 |
| Tensile strain at break [%] after aging at 60° C. for 7 d | 20.5 |
| Water vapor equivalent air layer thickness $s_D$ | 0.05 m |

Example IV

Production of First Coating 36 g of water, 0.5 g of 65% nitric acid, and 3.5 g of ethanol were used as initial charge, and 56 g of aluminum oxide powder ($d_{50}$=2.7 μm; BET=1.3 m$^2$/g), and also 0.07 g of dispersing agent, were added and stirred. A mixture made of 0.017 mol of silanes (Dynasylan® MTES, TEOS, and GLYMO in a ratio of 1.00:0.86:1.51) was added to said dispersion. The mixture was stirred for 24 h at room temperature.

A PET non-woven (weight per unit area: 45 g/m$^2$; thickness 0.39 mm) was saturated with said dispersion and dried at 220° C. in an oven.

Production of Second Coating 1.6 g of water and 0.03 g of 65% $HNO_3$ were introduced into 18.8 g of Dynasylan GLYEO and stirred until clear. 7.8 g of Aerosil R812S and 44.4 g of ethanol were introduced into this solution. 16 g of Dynasylan AMEO and 2.3 g of Dynasylan IBTEO were added to said suspension and stirred at room temperature for a further 24 h. The previously coated substrate was coated with said mixture and dried at 150° C. in an oven.

Production of a Third Coating 3 g of Genagen LAB and 3 g of Fluowet UD were dissolved in 900 g of water, and 100 g of Nuva® TTC from Clariant were also introduced and mixed until homogeneous. This dispersion was foamed to give a foam weighing 50 g/L. Said foam was applied at about 100 g/m$^2$ to the substrate. The coated specimen was then dried at 100° C. and hardened at 180° C. for 30 sec.

Testing of said material gave the following property profile:

| | |
|---|---|
| Stain resistance factor | 5 |
| Abrasion resistance | 2 |
| Tensile strain at break [%] | 17.5 |
| Tensile strain at break [%] after aging at 60° C. for 7 d | 16.8 |

What is claimed is:

1. A process for producing a flexible mineral construction material, the process comprising:

(1) applying a composition on at least one side of a substrate, said composition comprising an inorganic compound comprising:

at least one metal, semimetal, or both, selected from the group consisting of Sc, Y, Ti, Zr, Nb, V, Cr, Mo, W, Mn, Fe, Co, B, Al, In, Tl, Si, Ge, Sn, Zn, Pb, Sb, Bi, and a mixture thereof; and at least one element selected from the group consisting of Te, Se, S, O, Sb, As, P, N, C, Ga, and a mixture thereof, and drying said composition; and then (2) applying a first coating on at least one side of the substrate, said first coating comprising:

a first mixture of silanes comprising a silicon alcoholate and silanes of the formula $(Z^1)Si(OR)_3$, wherein:

$Z^1$ represents R, 3-glycidyloxypropyl, 3-aminopropyl, N-(2-aminoethyl)-3-aminopropyl, or a mixture thereof; and R independently represents an identical or different alkyl or alicyclic group comprising from 1 to 18 carbon atoms, and wherein at least one of said silanes of formula $(Z^1)Si(OR)_3$ has $Z^1$=N-(2-aminoethyl)-3-aminopropyl, and the first mixture of silanes comprises the silicon alcoholate, an alkyl silane of formula $(Z^1)Si(OR)_3$ in which $Z^1$ represents R, and a glycidyloxypropyl silane of the formula $(Z^1)Si(OR)_3$ in which $Z^1$ represents 3-glycidyloxypropyl, such that:

a molar ratio of the silicon alcoholate to the alkyl silane ranges from 1:1 to 1:0.96; and a molar ratio of the silicon alcoholate to the glycidyloxypropyl silane ranges from 1:0.57 to 1:1.51;

at least one oxide particle selected from the group consisting of an oxide of Ti, an oxide of Si, an oxide of Zr, an oxide of Al, an oxide of Y, an oxide of Sn, an oxide of Zn, and oxide of Ce, and mixtures thereof; and a polymer or initiator, and drying the at least first coating, and then (3) applying a second coating on the first coating, said second coating comprising a second mixture of silanes comprising a silane of the formula (3-glycidyloxypropyl)$Si(OR)_3$, a silane of the formula (3-aminopropyl)$Si(OR)_3$, and a silane of the formula $RSi(OR)_3$, in which R independently represents an identical or different alkyl or alicyclic group comprising from 1 to 18 carbon atoms, and drying the second coating, and then (4) applying at least one organic polymer dispersion (3) to at least one side of the substrate to form at least one third coating, and drying the at least one third coating.

2. The process of claim 1, wherein the organic polymer dispersion (3) is selected from the group consisting of a polyacrylate, a polymethacrylate, a polyurethane, a polyester, a copolymer with a vinyl monomer, a cocondensate with a vinyl monomer and a combination thereof.

3. The process of claim 1, wherein the organic polymer dispersion (3) is applied such that a last organic polymer dispersion (3) applied to the substrate comprises a fluorocarbon.

4. The process of claim 1, wherein the composition comprises a metal oxide.

5. The process of claim 1, wherein the flexible mineral construction material produced has the following characteristics:

a stain resistance factor of at most 10;

a tensile strain at break of at least 13%;

a tensile strain at break of at least 10% after 7 d of aging at 60° C.;

a minimum bending radius of at most 3 mm; and a water vapor equivalent air-layer thickness $s_D$ of at most 0.2 m.

6. The process of claim 4, wherein the composition is an aqueous dispersion of the metal oxide.

7. The process of claim 1, wherein the composition, the first coating, the second coating and the organic polymer dispersion are all applied to the same side of the substrate.

8. The process of claim 5, wherein the composition, the first coating, the second coating and the organic polymer dispersion are all applied to the same side of the substrate.

9. The process of claim 1, wherein said first coating comprises N-2-aminoethyl-3-aminopropyltriethoxysilane and at least one of 3-glycidyloxypropyltriethoxysilane and 3-glycidyloxypropyltrimethoxysilane.

10. The process of claim 1, wherein said first coating comprises at least one of butyltriethoxysilane, isobutyltriethoxysilane, octyltriethoxysilane, dodecyltriethoxysilane and hexadecyltriethoxysilane.

11. The process of claim 9, wherein said first coating comprises at least one of butyltriethoxysilane, isobutyltriethoxysilane, octyltriethoxysilane, dodecyltriethoxysilane and hexadecyltriethoxysilane.

12. The process of claim 10, wherein the flexible mineral construction material produced has the following characteristics:

a stain resistance factor of at most 10;

a tensile strain at break of at least 13%;

a tensile strain at break of at least 10% after 7 d of aging at 60° C.;

a minimum bending radius of at most 3 mm; and a water vapor equivalent air-layer thickness $s_D$ of at most 0.2 m.

13. The process of claim 11, wherein the flexible mineral construction material produced has the following characteristics:

a stain resistance factor of at most 10;

a tensile strain at break of at least 13%;

a tensile strain at break of at least 10% after 7 d of aging at 60° C.;

a minimum bending radius of at most 3 mm; and a water vapor equivalent air-layer thickness $s_D$ of at most 0.2 m.

14. The process of claim 12, wherein the composition, the first coating, the second coating and the organic polymer dispersion are all applied to the same side of the substrate.

15. The process of claim 13, wherein the composition, the first coating, the second coating and the organic polymer dispersion are all applied to the same side of the substrate.

* * * * *